US007652419B2

(12) United States Patent
Ahn et al.

(10) Patent No.: US 7,652,419 B2
(45) Date of Patent: Jan. 26, 2010

(54) ELECTRON EMISSION DEVICE AND ELECTRON EMISSION DISPLAY USING THE SAME

(75) Inventors: Sang-Hyuck Ahn, Yongin-si (KR); Sang-Jo Lee, Yongin-si (KR); Byung-Gil Jea, Yongin-si (KR); Sang-Ho Jeon, Yongin-si (KR); Su-Bong Hong, Yongin-si (KR); Jin-Hui Cho, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 372 days.

(21) Appl. No.: 11/702,539

(22) Filed: Feb. 6, 2007

(65) Prior Publication Data

US 2007/0194689 A1 Aug. 23, 2007

(30) Foreign Application Priority Data

Feb. 20, 2006 (KR) ..... 10-2006-0016404

(51) Int. Cl.
*H01J 1/62* (2006.01)

(52) U.S. Cl. ..... 313/497; 313/495; 445/24; 445/25

(58) Field of Classification Search ..... 313/495–497
See application file for complete search history.

(56) References Cited

U.S. PATENT DOCUMENTS

| | | | |
|---|---|---|---|
| 7,176,615 | B2 | 2/2007 | Song et al. |
| 7,372,193 | B2 | 5/2008 | Hirokado |
| 2004/0004429 | A1 | 1/2004 | Oh et al. |
| 2004/0256969 | A1 | 12/2004 | Dijon et al. |
| 2005/0133779 | A1 | 6/2005 | Choi et al. |
| 2005/0184647 | A1 | 8/2005 | Chang |
| 2005/0264170 | A1 | 12/2005 | Oh |

FOREIGN PATENT DOCUMENTS

| | | |
|---|---|---|
| CN | 1598999 | 3/2005 |
| EP | 0 545 621 | 6/1993 |
| EP | 1 511 059 | 3/2005 |

(Continued)

OTHER PUBLICATIONS

Search Report issued on Jun. 26, 2007 by the European Patent Office for European Application No. 07102431.9.

*Primary Examiner*—Nimeshkumar D. Patel
*Assistant Examiner*—Mary Ellen Bowman
(74) *Attorney, Agent, or Firm*—Stein McEwen, LLP

(57) ABSTRACT

An electron emission device includes a substrate, first electrodes formed on the substrate, electron emission regions electrically connected to the first electrodes, and second electrodes placed over the first electrodes such that the second electrodes are insulated from the first electrodes. The second electrodes have openings to expose the electron emission regions. A third electrode is placed over the second electrodes such that the third electrode is insulated from the second electrodes. The third electrode has openings communicating with the openings of the second electrodes. Each of the electron emission regions and the second electrodes simultaneously satisfy the following conditions:

$$D2/D1 \leqq 0.579 \quad (1),$$

and $$D2 \geqq 1\ \mu \quad (2)$$

where D1 indicates the width of each of the openings of the second electrode, and D2 indicates the width of each of the electron emission regions.

19 Claims, 4 Drawing Sheets

FOREIGN PATENT DOCUMENTS

| | | |
|---|---|---|
| FR | 2 669 465 | 5/1992 |
| JP | 2004-311243 | 11/2004 |
| JP | 2005-071993 | 3/2005 |
| JP | 2005-518636 | 6/2005 |
| JP | 2005-243609 | 9/2005 |
| WO | WO 2003/017571 | 8/2003 |

ELECTRON EMISSION DEVICE AND ELECTRON EMISSION DISPLAY USING THE SAME

CROSS-REFERENCE TO RELATED APPLICATION

This application claims the benefit of Korean Application No. 2006-16404 filed on Feb. 20, 2006 in the Korean Intellectual Property Office, the disclosure of which is incorporated herein by reference.

BACKGROUND OF THE INVENTION

1. Field of the Invention

Aspects of the present invention relate to an electron emission device, and in particular, to an electron emission device having a predetermined ratio of a width of an electron emission region to a width of an opening of a gate electrode, and an electron emission display using the electron emission device.

2. Description of the Related Art

Generally, electron emission elements are classified into different types depending on the types of electron sources. These include a first type using a hot cathode and a second type using a cold cathode.

The second type electron emission elements using a cold cathode include a field emission array (FEA) type, a surface-conduction emission (SCE) type, a metal-insulator-metal (MIM) type, and a metal-insulator-semiconductor (MIS) type.

The FEA-type electron emission element has an electron emission region and driving electrodes, such as a cathode electrode and a gate electrode. The FEA-type electron emission element is based on the principle that when an electric field is applied to the electron emission region under a vacuum, electrons are easily emitted from the electron emission region. The electron emission region is formed with a material having a low work function or a high aspect ratio, such as a carbonaceous material or a nanometer-sized material.

Several of the electron emission elements are arranged on a first substrate into arrays to make an electron emission device, and the electron emission device is combined with a second substrate having a light emission unit with a phosphor layer and an anode electrode. These components are used to construct an electron emission display.

With the common FEA-type electron emission display, cathode electrodes, an insulating layer, and gate electrodes are sequentially formed on the first substrate, and openings are formed at the gate electrodes and the insulating layer to partially expose the cathode electrodes. Electron emission regions are formed on the cathode electrodes within the openings. Phosphor layers and the anode electrode are formed on a surface of the second substrate facing the first substrate.

The cathode and the gate electrodes are stripe-patterned and formed to cross each other, and each crossed area of the cathode and gate electrodes forms a pixel. The electron emission regions are placed at a predetermined domain of the pixel such that the electron emission regions are spaced apart from each other by a distance.

When predetermined driving voltages are applied to the cathode and the gate electrodes, electric fields are formed around the electron emission regions at the pixels where the voltage difference between the two electrodes exceeds a threshold value, and electrons are emitted from those electron emission regions. The emitted electrons are attracted by a high voltage applied to the anode electrode, and directed toward the second substrate. When the emitted electrons reach the second substrate, the emitted electrons collide against the phosphor layers at the relevant pixels and cause emission of light.

With the above structure, an insulating layer and a focusing electrode may be further formed over the gate electrodes to focus the electron beams. The focusing electrode receives 0V or a negative direct current (DC) voltage of several to several tens of volts, and exerts a repulsive force to the emitted electrons passing through the opening in the gate electrodes and the insulating layer to focus those electrons in the center of a stream of electrons.

Meanwhile, unlike the cone-shaped Spindt-type emitters proposed in the early stages of the electron emitter design, the electron emission region may be formed with a layer having an electron emission material on the surface thereof, mainly through the easily-controlled screen printing process.

Electron beams from the electron emission display having the layered electron emission regions and the focusing electrode include main and sub electron beams within the stream of electron beams. The main electron beams are existent among the stream of electron beams together with sub electron beams. The sub electron beams are placed external to the main electron beams. The width of each of the sub electron beams is larger than that of the main electron beam, and the intensity of each of the sub electron beam is weaker than that of the main electron beam.

Accordingly, the phosphor layer is demarcated into a primary light emission area based on the main electron beam and a secondary light emission area based on the sub electron beam when light is emitted. In case the sub electron beam is widely diffused to neighboring different-colored phosphor layers, those different-colored phosphor layers are excited so that the color purity deteriorates.

The sub electron beam causing the secondary light emission is generated due to the phenomenon where the electrons emitted from the edge of the electron emission region are attracted by the gate electrode, and some of the electrons passing close to the focusing electrode are radically bent to the opposite side by the negative electric field of the focusing electrode.

In order to prevent the sub electron beams from being generated, it has been conventionally proposed that the shape or size of the opening of the focusing electrode should be altered, or the dimension of the focusing voltage should be controlled. However, when the width of the opening of the focusing electrode is enlarged or the focusing voltage is raised to prevent the generation of the sub electron beams, the width of the main electron beam is instead enlarged to thereby increase the width of the primary light emission area, even though the sub electron beams are prevented from being generated, and thereby decreasing the secondary light emission.

SUMMARY OF THE INVENTION

Accordingly, various aspects of the present invention includes an electron emission device which reduces the sub electron beams from being generated to minimize the secondary light emission while not largely influencing the main electron beams, and an electron emission display using the electron emission device.

In an aspect of the present invention, the electron emission device includes a substrate, first electrodes formed on the substrate, electron emission regions electrically connected to the first electrodes, and second electrodes placed over the first electrodes such that the second electrodes are insulated from the first electrodes. The second electrodes have openings to expose the electron emission regions. A third electrode is placed over the second electrodes such that the third electrode is insulated from the second electrodes. The third electrode has openings communicating with the openings of the second electrodes. Each of the electron emission regions and the second electrodes simultaneously satisfy the following conditions:

$$D2/D1 \leqq 0.579 \quad (1),$$

and $$D2 \geqq 1\ \mu m \quad (2)$$

where D1 indicates the width of each of the openings of the second electrode, and D2 indicates the width of each of the electron emission regions.

The electron emission regions and the openings of the second electrodes may be serially arranged in the direction of the length of the first electrodes, and D1 and D2 are measured in the direction of the width of the first electrodes.

The electron emission regions and the openings of the second electrodes may be formed in the shape of a circle.

Each of the electron emission regions may be formed as any one of an electron emission layer formed entirely of an electron emission material and an electron emission layer having an electron emission material formed on a surface thereof.

The third electrode may have one of the openings at each crossed area of the first and the second electrodes.

It is possible that any one of the first and the second electrodes is a scan electrode, and the other of the first and second electrodes is a data electrode, while the third electrode is a focusing electrode.

In another exemplary embodiment of the present invention, the electron emission display includes first and second substrates facing each other with a predetermined distance, first electrodes formed on the first substrate, electron emission regions electrically connected to the first electrodes, and second electrodes placed over the first electrodes such that the second electrodes are insulated from the first electrodes. The second electrodes have openings to expose the electron emission regions. A third electrode is placed over the second electrodes such that the third electrode is insulated from the second electrodes. The third electrode has openings communicating with the openings of the second electrodes. Phosphor layers are formed on a surface of the second substrate. A fourth electrode is placed on a surface of the phosphor layers. The electron emission regions and the second electrodes simultaneously satisfy the following conditions:

$$D2/D1 \leqq 0.579 \quad (1),$$

and $$D2 \geqq 1\ \mu m \quad (2)$$

where D1 indicates the width of each of the openings of the second electrode, and D2 indicates the width of each of the electron emission regions.

The phosphor layers may include red, green, and blue phosphor layers alternately arranged in a first direction on the second substrate, and D1 and D2 may be measured perpendicular to the first direction on the second substrate.

The electron emission regions and the openings of the second electrodes may be serially arranged in a second direction perpendicular to the first direction on the second substrate.

An aspect of the present invention includes an electron emission structure, including: a first electrode; an electron emission region to emit an electron stream and formed on the first electrode; and a second electrode and formed perpendicularly to the first electrode, wherein the second electrode further comprises a hole sized and positioned to correspond to the electrode emission region so that a main electron beam and a sub electron beam of the electron stream emitted from the electron emission region have substantially equal width at a predetermined distance from the electron emission region.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the aspects, taken in conjunction with the accompanying drawings of which.

DETAILED DESCRIPTION OF THE EMBODIMENTS

Figure 1:
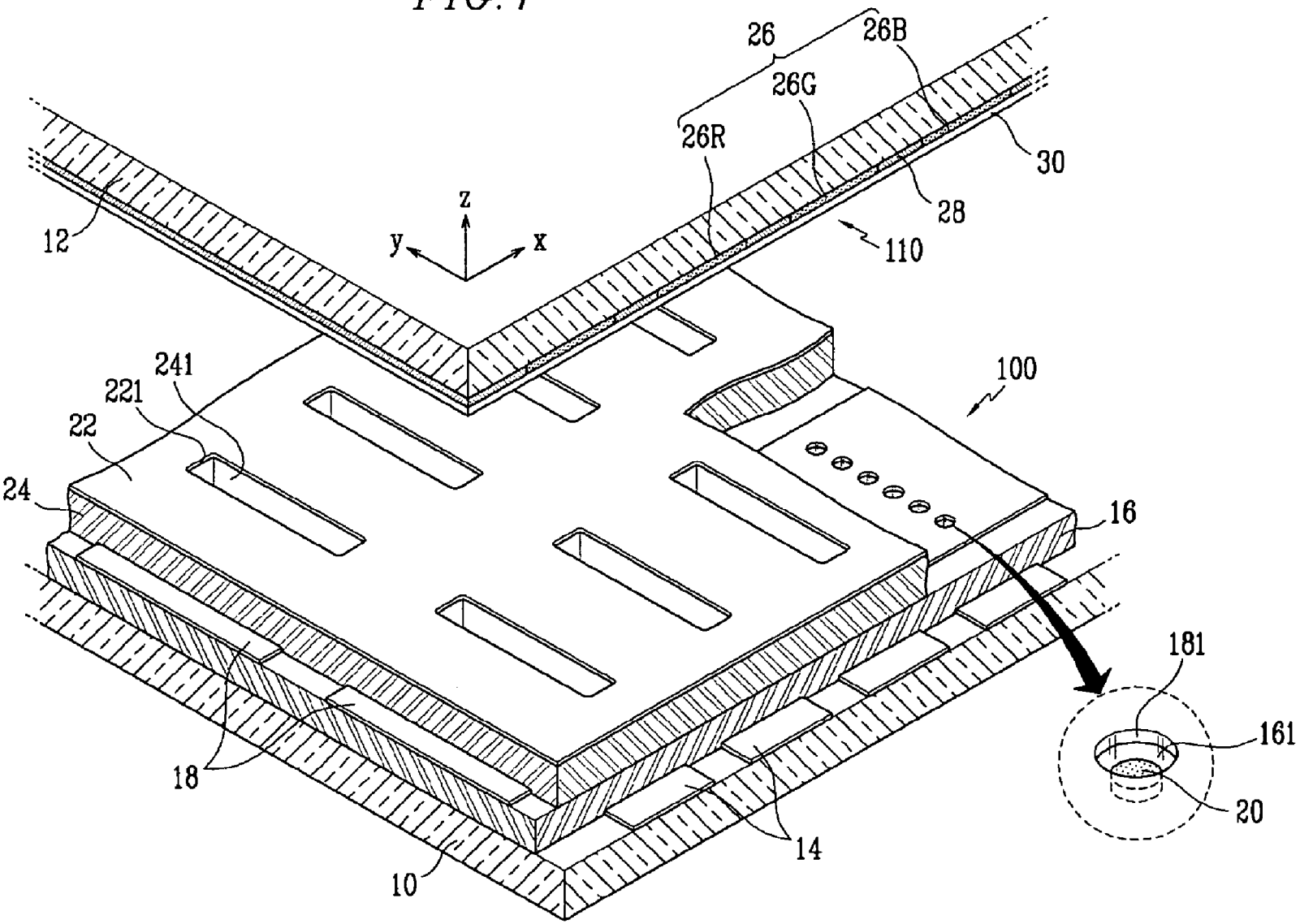
FIG. 1 is a partial exploded perspective view of an electron emission display according to an aspect of the present invention.

Reference will now be made in detail to the aspects of the present invention, examples of which are illustrated in the accompanying drawings, wherein like reference numerals refer to the like elements throughout. The aspects are described below in order to explain the present invention by referring to the figures.

Figure 2:
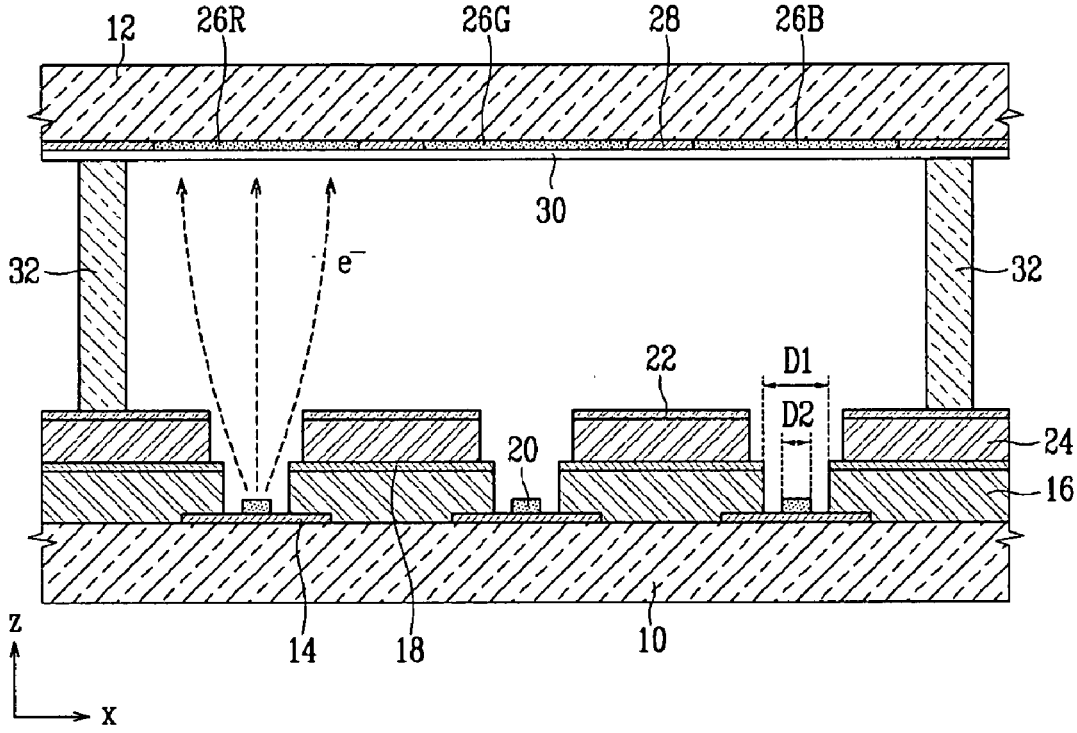
FIG. 2 is a partial sectional view of an electron emission display shown in FIG. 1.
Figure 3:
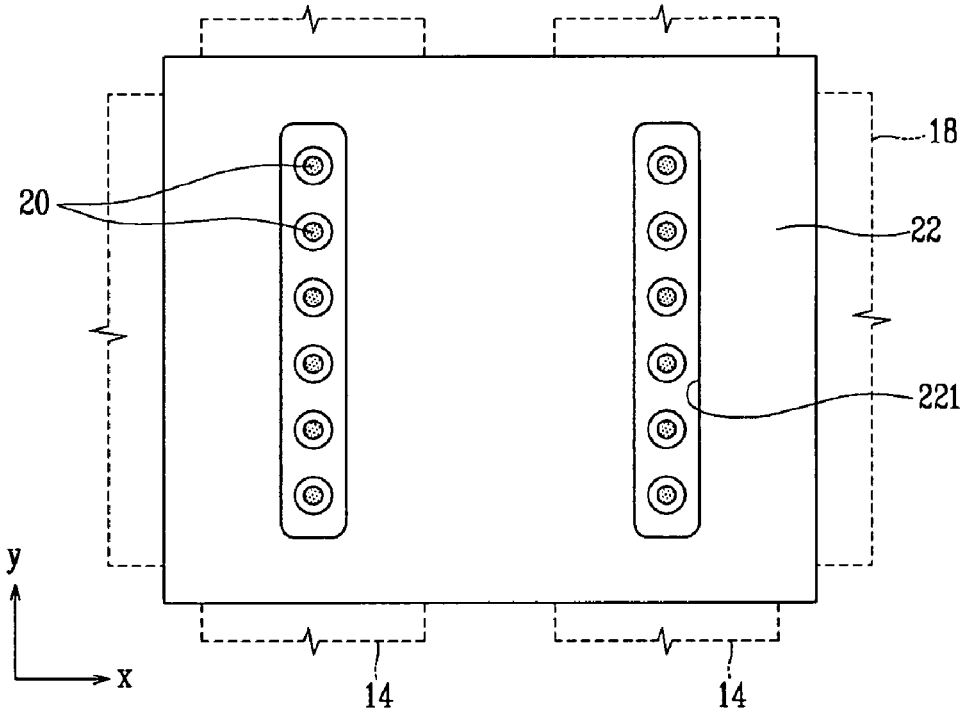
FIG. 3 is a partial amplified plan view of the electron emission device according to an aspect of the present invention.

As shown in FIGS. 1 to 3, an electron emission display includes first and second substrates 10 and 12 facing each other with a predetermined distance. A sealing member (not shown) is provided at the peripheries of the first and the second substrates 10 and 12 to seal them to each other, and the inner space between the substrates 10 and 12 is evacuated to about $10^{-6}$ Torr. In this way, the first and the second substrates 10 and 12 and the sealant forms a vacuum vessel.

Arrays of electron emission elements are arranged on a surface of the first substrate 10 facing the second substrate 12. The arrays of electron emission elements are used to construct an electron emission device 100 on the first substrate 10. The electron emission device 100 is assembled with the second substrate 12 and a light emission unit 110 provided on the second substrate 12 to construct an electron emission display.

As parts of the electron emission device 100, cathode electrode or electrodes 14 (first electrodes) are stripe-patterned (or bands) formed on the first substrate 10 and extend in a direction of the first substrate 10. A first insulating layer 16 is formed on the entire surface of the first substrate 10 such that first insulating layer 16 covers the cathode electrodes 14. Gate electrode or electrodes 18 (second electrodes) are stripe-patterned (or bands) formed on the first insulating layer 16 and extend in a direction substantially perpendicular to the cathode electrodes 14.

When the crossed (or intersected) areas of the cathode and the gate electrodes 14 and 18 are defined as pixels, electron emission region or regions 20 are formed on the cathode electrodes 14 of the respective pixels. To expose the electron emission regions 20 on the first substrate 10, openings 161 and 181 are formed respectively at the first insulating layer 16 and the gate electrodes 18 corresponding to the respective electron emission regions 20.

The electron emission region 20 is formed with a material (electron emission material) that emits electrons when an electric field is applied thereto under a vacuum. Such a material includes a carbonaceous material or a nanometer (nm) size material. For instance, the electron emission region 20 may be formed with carbon nanotube, graphite, graphite nanofiber, diamond, diamond-like carbon, fullerene $C_{60}$, silicon nanowire, or a combination thereof.

The electron emission regions 20 are formed with an electron emission layer (not shown) having a predetermined thickness and a predetermined width. The electron emission layer may be formed entirely of an electron emission material, or of a structure having the electron emission material formed on the surface thereof. The electron emission region 20 may be formed through screen printing, direct growth, chemical vapor deposition, and/or sputtering.

In various aspects, the electron emission regions 20 are serially arranged on the respective pixels in the direction of the length of any one of the cathode and the gate electrodes 14 and 18. For example, as shown in FIG. 1, the electron emission regions 20 are arranged in the longitudinal direction of the cathode electrode 14. Each of the electron emission regions 20 and the openings 181 of the gate electrode 18 may be formed in the shape of a circle. In other aspects, the shape of the electron emission regions 20 and the openings 181 of the gate electrode 18 may be an oval, a rectangle, or others. Also, within a grouping of the electron emission regions 20 and the openings 181, an individual electron emission region 20 or an opening 181 may be shaped differently from the others.

A focusing electrode 22 (a third electrode) is formed on the gate electrodes 18 and the first insulating layer 16. A second insulating layer 24 is placed under the focusing electrode 22 to insulate the gate and the focusing electrodes 18 and 22 from each other. To pass the electron beams, openings 221 and 241 are also respectively formed in the focusing electrode 22 and the second insulating layer 24. In various aspects of the present invention, the first, second, and third electrodes 14, 18, 22 form a step structure as shown in FIG. 2.

Figure 4:
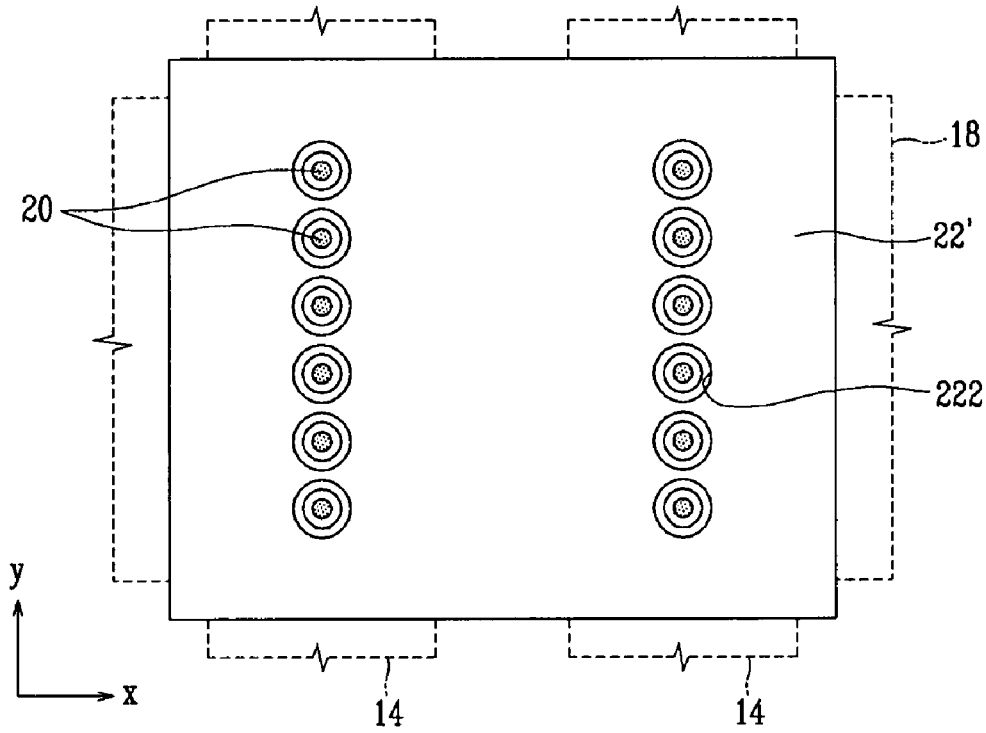
FIG. 4 is a partial amplified plan view of an electron emission device illustrating a variant of a focusing electrode.

As shown in FIGS. 1 and 3, one opening 221 may be formed in the focusing electrode 22 at each pixel to collectively focus the electrons emitted from each pixel. Alternatively, as shown in FIG. 4, one opening 222 is formed at the focusing electrode 22' per each electron emission region 20 to separately focus the electrons from the respective electron emission regions 20.

As parts of the electron emission display, in various aspects of the present invention, phosphor layers 26 are formed on a surface of the second substrate 12 facing the first substrate 10. The phosphor layers 26 have red, green, and blue phosphor layers 26R, 26G, and 26B such that they are spaced apart from each other by a distance. A black layer 28 is disposed between the respective red, green, and blue phosphor layers 26R, 26G, and 26B to enhance the screen contrast. Each of the colored phosphor layers 26R, 26G, and 26B is placed in each pixel, and the red, green and blue phosphor layers 26R, 26G, and 27B are alternately arranged in the corresponding longitudinal direction of the gate electrode 18.

An anode electrode 30 is formed on the phosphor and the black layers 26 and 28. The anode electrode 30 may be a metallic material, such as aluminum Al. The anode electrode 30 receives a high voltage required to accelerate electron beams from the electron emission regions 20, makes the phosphor layers 26 be in a high potential state, and reflects visible rays radiated from the phosphor layers 26 toward the second substrate 12 to heighten the screen luminance.

In various aspects, the anode electrode 30 may be formed with a transparent conductive material, such as indium tin oxide (ITO). In such a case, the anode electrode 30 is placed on a surface of the phosphor and the black layers 26 and 28 that face toward the second substrate 12. It is also possible that a transparent conductive layer (such as ITO) and a metallic layer (such as Al) are both formed to function as the anode electrode 30.

As shown in FIG. 2, spacers 32 are disposed between the first and the second substrates 10 and 12 to support the pressure applied to the vacuum vessel and constantly sustain the distance between the two substrates 10 and 12. The spacers 32 are located at corresponding locations to the black layers 28 such that the spacers 32 do not intrude upon the phosphor layers 26.

The above-structured electron emission display is driven by supplying predetermined voltages to the cathode electrodes 14, the gate electrodes 18, the focusing electrode 22, and the anode electrode 30.

During operation of the electron emission display, one of the cathode and the gate electrodes 14 and 18 receives a scan driving voltage to function as a scan electrode, and the other electrode receives a data driving voltage to function as a data electrode. The focusing electrode 22 receives a voltage required for focusing the electron beams, such as 0V or a negative direct current (DC) voltage of several to several tens of volts. The anode electrode 30 receives a voltage required for accelerating the electron beams, such as a positive direct current (DC) voltage of several hundreds to several thousands of volts.

During operation of the electron emission display, an electric field is formed around the electron emission regions 20 at the pixels where the voltage difference between the cathode and the gate electrodes 14 and 18 exceeds a threshold value, and electrons are emitted from those electron emission regions 20. The emitted electrons pass through the openings 221 of the focusing electrode 22, and are focused at the center of the stream of electron beams. The emitted electrons are attracted by the high voltage applied to the anode electrode 30, collide against the phosphor layers 26 at the relevant pixels, and cause emission of light.

Figure 5:
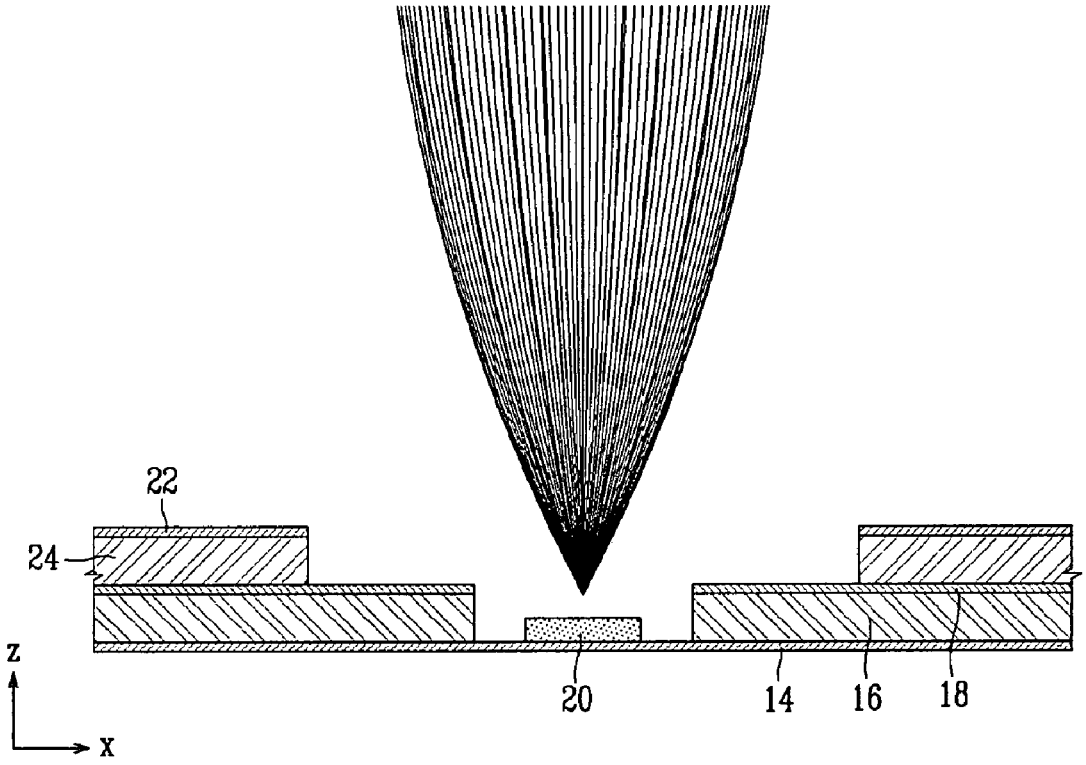
FIG. 5 schematically illustrates the trajectories of the electron beams emitted from the center of an electron emission region of an electron emission display according to an aspect of the present invention.
Figure 6:
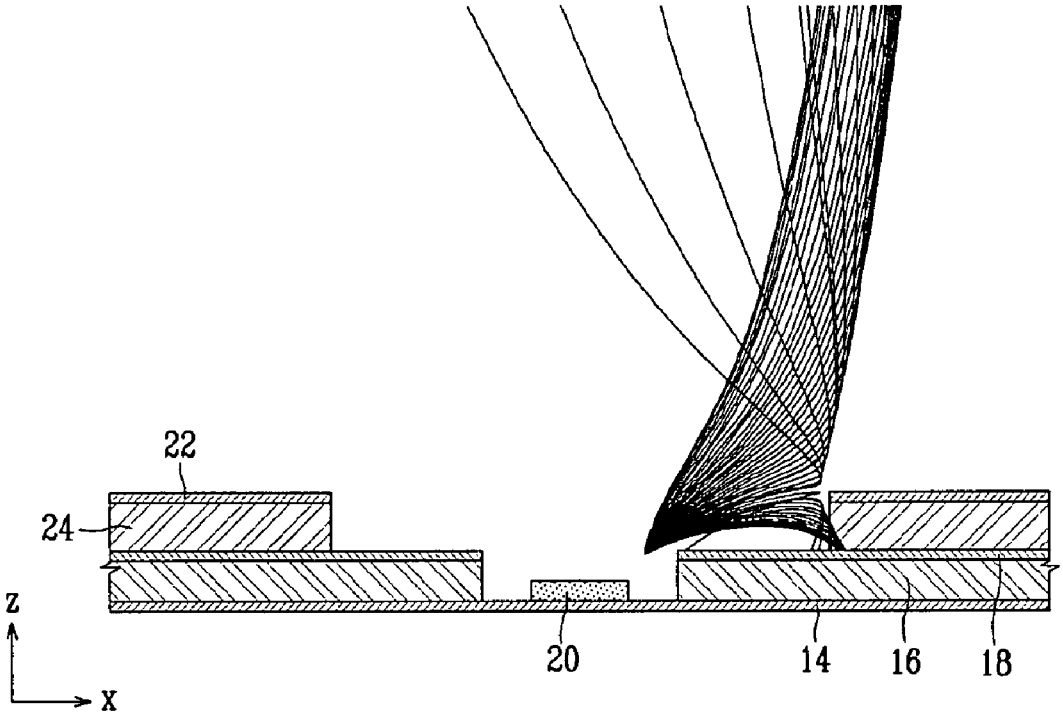
FIG. 6 schematically illustrates the trajectories of the electron beams emitted from the edge of an electron emission region of an electron emission display according to an aspect of the present invention.

FIGS. 5 and 6 show the trajectories of the electron beams emitted from or near the center of the electron emission region 20 and from or near the edge thereof, respectively. Shown is the sectional view of the electron emission device 100 taken in the direction of the width of the cathode electrode 14 (in the x axis direction of the drawing FIGS. 1-6) and the trajectories of the electron beams.

As shown in FIG. 5, the left and the right sides of the stream of electron beams emitted from or near the center of the electron emission region 20 are symmetrical or substantially symmetrical to each other with respect to a center of the stream. The electron beams are diffused (or fanned out) toward the second substrate (not shown), and are entirely of main electron beams without sub electron beams.

Meanwhile, as shown in FIG. 6, the electrons emitted from or near the edge of the electron emission region 20 are biased to the gate electrode 18 in the side direction, and proceed toward the second substrate (not shown) to join the main electron beams. However, some of the electrons passing close to the focusing electrode 22 are radically bent away from the main electron beams by the negative (or the opposite) electric field of the focusing electrode 22 to thereby form the sub electron beams.

In this way, the sub electron beams with a width larger than the main electron beams are formed external to (or outside of) the main electron beams due to the electrons that are mainly emitted from or near the edge of the electron emission region 20. Accordingly, a secondary light emission area based on the sub electron beams is formed on the phosphor layer 26 external to (or outside of) the primary light emission area of the phosphor layer 26 or the pixel.

The secondary light emission occurs because the electron emission region 20 has a relatively wide electron emission area as it is formed with an electron emission layer having a predetermined width, which is different from the Spindt type electron emitter of the conventional art.

To reduce the secondary light emission, the electron emission display according to an aspect of the present invention has a predetermined ratio of a width of the electron emission region 20 to a width of the opening 181 of the gate electrode 18 to thereby reduce and/or prevent the sub electron beams from being generated. In this aspect, the electron emission region 20 and the gate electrode 18 are structured to satisfy the following condition:

$$D2/D1 \leqq 0.579 \quad (1)$$

where D1 and D2 indicate the width of the opening 181 of the gate electrode 18 and the width of the electron emission region 20, respectively. The D1 and D2 are measured in the neighboring direction of the different-colored phosphor layers 26R, 26G, and 26B (that is, in the direction of the width of the cathode electrode 14). In an aspect where the electron emission region 20 and the opening 181 of the gate electrode 18 are formed in the shape of a circle, D1 and D2 may indicate the diameter of the opening 181 of the gate electrode 18 and the diameter of the electron emission region 20, respectively.

Figure 7:
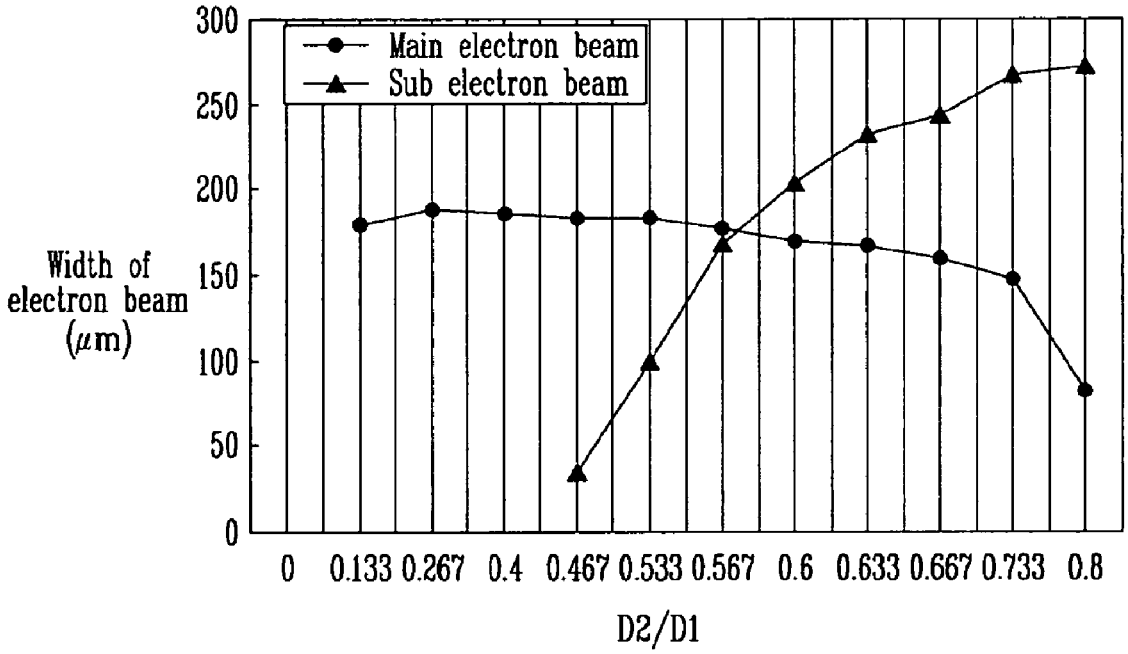
FIG. 7 is a graph illustrating the widths of main and sub electron beams measured when the ratio of a width of an electron emission region to a width of an opening of a gate electrode of an electron emission display is varied according to an aspect of the present invention.

FIG. 7 is a graph illustrating the widths of the main and the sub electron beams that collide with the phosphor layer 26 measured while the ratio of the width of the electron emission region 20 to the width of the opening 181 of the gate electrode 18 is varied. The widths of the main and the sub electron beams illustrated in the graph indicate the widths thereof measured in the neighboring direction of the different-colored phosphor layers 26R, 26G, and 26B.

According to an aspect of the electron emission display, the thickness of the first insulating layer 16 was established to be 3 μm, the width of the opening 181 of the gate electrode 18 was established to be 15 μm, the thickness of the second insulating layer 24 was established to be 4 μm, and the width of the opening 221 of the focusing electrode 22 was established to be 38 μm. Also, the widths of the main and the sub electron beams were measured while varying the width of the electron emission region from 2 μm to 12 μm. Also, as to the driving conditions, the cathode voltage was established to be 20V, the gate voltage was established to be 80V, the focusing voltage was established to be 0V, and the anode voltage was established to be 8 kV.

As shown in FIG. 7, as the width ratio D2/D1 of the electron emission region 20 to the opening 181 of the gate electrode 18 is increased, the width of the main electron beam is gradually reduced while the width of the sub electron beam is radically enlarged. Particularly, when the width ratio D2/D1 of the electron emission region 20 to the opening 181 of the gate electrode 18 exceeds 0.579, the width of the sub electron beam increases beyond the width of the main electron beam. When the ratio D2/D1 is above 0.579, a secondary light emission area is present. As shown in FIG. 7, the ratio D2/D1 of 0.579 represents a situation when the width of the main electron beam and the width of the sub electron beams are essentially equal. In one aspect of the present invention, the widths of the main and sub electron beams are about 175 μm.

As discussed above, according to the aspect of the present invention, the ratio of the width D2 of the electron emission region 20 to the width D1 of the opening 181 of the gate electrode 18 should be less than 0.579, although not required. As a result, the generation of the sub electron beams is effectively reduced without radically reducing the width of the main electron beam.

Meanwhile, it is preferable, though not required, that the electron emission region 20 has a width of 1 μm or more. When the electron emission region 20 has a width of less than 1 μm, it is difficult to pattern (or fabricate) the electron emission regions 20. In particular, there is a difficulty in the light exposure process during its fabrication, which occurs after a paste mixture containing an electron emission material and a photosensitive material is printed on the entire surface of the first substrate, and selectively hardened through the light exposure. Afterwards, the non-hardened portions are removed through the developing process to form the electron emission regions 20.

Furthermore, when the electron emission region has a width of less than 1 μm, the amount of discharge current from the electron emission region is reduced, and hence, the driving voltage needs to be raised. Accordingly, the driving voltage of the electron emission region having a width of 2 μm should be raised by three times to that of the electron emission region having a width of 6 μm and the driving voltage of the electron emission region having a width of 1 μm should be raised by six times to that of the electron emission region having a width of 6 μm. Accordingly, in this aspect, the electron emission region 20 is formed with a width of at least about 1 μm.

As described above, with the electron emission display according to the aspects, as the electron emission region 20 and the gate electrode 18 are structured to satisfy the above-identified conditions, the secondary light emission is reduced to thereby enhance the color purity, and an optimum light emission area is obtained so that the emission efficiency of the electron emission region 20 is heightened even with a lower driving voltage.

Although a few aspects of the present invention have been shown and described, it would be appreciated by those skilled in the art that changes may be made in the aspects without departing from the principles and spirit of the invention, the scope of which is defined in the claims and their equivalents.

What is claimed is:

1. An electron emission device comprising:

a substrate;

first electrodes formed on the substrate;

electron emission regions electrically connected to the first electrodes;

second electrodes placed over the first electrodes such that the second electrodes are insulated from the first electrodes, the second electrodes having openings to expose the electron emission regions; and a third electrode placed over the second electrodes such that the third electrode is insulated from the second electrodes, the third electrode having openings communicating with the openings of the second electrodes;

wherein each of the electron emission regions and the second electrodes simultaneously satisfy the following conditions:

$$D2/D1 \leqq 0.467 \quad (1)$$

and $$D2 \geqq 1\ \mu m \quad (2)$$

where D1 indicates the width of each of the openings of the second electrodes, and D2 indicates the width of each of the electron emission regions.

2. The electron emission device of claim 1, wherein D1 and D2 are measured in the direction of the width of any one of the first and the second electrodes.

3. The electron emission device of claim 2, wherein the electron emission regions and the openings of the second electrodes are serially arranged in the direction of the length of the first electrodes, and D1 and D2 are measured in the direction of the width of the first electrodes.

4. The electron emission device of claim 2, wherein the electron emission regions and the openings of the second electrodes are formed in the shape of a circle.

5. The electron emission device of claim 1, wherein each of the electron emission regions is formed as any one of an electron emission layer formed entirely of an electron emission material and an electron emission layer having an electron emission material formed on a surface thereof.

6. The electron emission device of claim 5, wherein the electron emission region comprises at least one of carbon nanotube, graphite, graphite nanofiber, diamond, diamond-like carbon, fullerene $C_{60}$, and silicon nanowire.

7. The electron emission device of claim 3, wherein the third electrode has one of the openings at each crossed area of the first and the second electrodes.

8. The electron emission device of claim 1, wherein any one of the first and the second electrodes is a scan electrode, and the other of the first and the second electrodes is a data electrode, while the third electrode is a focusing electrode.

9. An electron emission display comprising:

first and second substrates facing each other with a predetermined distance;

first electrodes formed on the first substrate;

electron emission regions electrically connected to the first electrodes;

second electrodes placed over the first electrodes such that the second electrodes are insulated from the first electrodes, the second electrodes having openings to expose the electron emission regions;

a third electrode placed over the second electrodes such that the third electrode is insulated from the second electrodes, the third electrode having openings communicating with the openings of the second electrodes;

phosphor layers formed on a surface of the second substrate; and a fourth electrode placed on a surface of the phosphor layers;

wherein the electron emission regions and the second electrodes simultaneously satisfy the following conditions:

$$D2/D1 \leqq 0.467 \quad (1)$$

and $$D2 \geqq 1\ \mu m \quad (2)$$

where D1 indicates the width of each of the openings of the second electrodes, and D2 indicates the width of each of the electron emission regions.

10. The electron emission display of claim 9, wherein the electron emission regions and the openings of the second electrodes are serially arranged in the direction of the length of the first electrodes, and D1 and D2 are measured in the direction of the width of the first electrodes.

11. The electron emission display of claim 9, wherein the electron emission regions and the openings of the second electrodes are formed in the shape of a circle.

12. The electron emission display of claim 9, wherein the phosphor layers comprise red, green and blue phosphor layers alternately arranged in a first direction on the second substrate, and D1 and D2 are measured perpendicular to the first direction on the second substrate.

13. The electron emission display of claim 12, wherein the electron emission regions and the openings of the second electrodes are serially arranged in a second direction perpendicular to the first direction on the second substrate.

14. The electron emission display of claim 9, wherein the electron emission region is formed as any one of an electron emission layer formed entirely of an electron emission material and an electron emission layer having an electron emission material formed on the surface thereof.

15. The electron emission display of claim 13, wherein the third electrode has one of the openings at each crossed area of the first and the second electrodes.

16. The electron emission display of claim 9, wherein any one of the first and the second electrodes is a scan electrode, and the other of the first and second electrodes is a data electrode, while the third electrode is a focusing electrode, and the fourth electrode is an anode electrode.

17. The electron emission device of claim 1, wherein the first, second, and third electrodes form a step structure.

18. The electron emission display of claim 9, wherein the first, second, and third electrodes form a step structure.

19. An electron emission structure, comprising:

a first electrode;

an electron emission region to emit an electron stream and formed on the first electrode; and a second electrode formed perpendicularly to the first electrode, wherein the second electrode further comprises a hole sized and positioned to correspond to the electrode emission region so that a main electron beam and a sub electron beam of the electron stream emitted from the electron emission region have substantially equal width at a predetermined distance from the electron emission region, wherein a width of the hole of the second electrode and a width of the electron emission region satisfies the following conditions:

$$D2/D1 \leqq 0.467 \quad (1)$$

and $$D2 \geqq 1\ \mu m \quad (2)$$

where D1 is the width of the hole and D2 is the width of electron emission region.

* * * * *

UNITED STATES PATENT AND TRADEMARK OFFICE

CERTIFICATE OF CORRECTION

PATENT NO. : 7,652,419 B2
APPLICATION NO. : 11/702539
DATED : January 26, 2010
INVENTOR(S) : Sang-Hyuck Ahn et al.

It is certified that error appears in the above-identified patent and that said Letters Patent is hereby corrected as shown below:

On the Title Pg Item (57) Abstract, line 15, change "D2≥1 μ" to --D2≥1 μm--.

Signed and Sealed this

Twenty-seventh Day of April, 2010

David J. Kappos

David J. Kappos
*Director of the United States Patent and Trademark Office*